United States Patent [19]

Hesse

[11] Patent Number: 4,940,443

[45] Date of Patent: Jul. 10, 1990

[54] RACE TRACK HAVING LATERAL EDGES AND BRIDGES FOR RETAINING TOY VEHICLES

[76] Inventor: Kurt Hesse, Waldstrasse 36, D-8510 Fürth, Fed. Rep. of Germany

[21] Appl. No.: 117,067

[22] PCT Filed: Nov. 5, 1986

[86] PCT No.: PCT/DE86/00448

§ 371 Date: Sep. 17, 1987

§ 102(e) Date: Sep. 17, 1987

[87] PCT Pub. No.: WO87/04363

PCT Pub. Date: Jul. 30, 1987

[30] Foreign Application Priority Data

Jan. 27, 1986 [DE] Fed. Rep. of Germany ..... 3602341

[51] Int. Cl.[5] ..... A63H 18/08

[52] U.S. Cl. ..... 446/445; 446/444; 446/431; 446/484

[58] Field of Search ..... 446/444, 445, 431, 484; 273/86 B; 104/118, 134, 242, 243, 244.1, DIG. 1; 105/216; 238/10 R, 10 A, 10 E

[56] References Cited

U.S. PATENT DOCUMENTS

| | | | |
|---|---|---|---|
| 456,438 | 7/1891 | Shaw | 104/243 X |
| 1,286,848 | 12/1918 | Walker | 104/242 X |
| 1,682,974 | 9/1928 | Lukens | 105/216 X |
| 3,209,491 | 10/1965 | Roeper | 446/444 X |
| 4,223,476 | 9/1980 | Meyer et al. | 104/305 |
| 4,521,206 | 6/1985 | Saffer et al. | 238/10 R X |
| 4,703,697 | 11/1987 | Bell | 104/134 X |

FOREIGN PATENT DOCUMENTS

| | | | |
|---|---|---|---|
| 2833159 | 2/1980 | Fed. Rep. of Germany | 273/86 B |
| 2949046 | 6/1981 | Fed. Rep. of Germany | 273/86 B |

*Primary Examiner*—Robert A. Hafer
*Assistant Examiner*—Sam Rimell
*Attorney, Agent, or Firm*—Collard, Rod & Galgano

[57] ABSTRACT

An automobile race track toy set is provided, having a roadway formed by straight and curved raceway segments, with two lanes having embedded current conductors therein. The raceway segments include inside and outside guiding edges, along which toy vehicles slide by means of a bridge which projects beyond the lateral surfaces of the toy vehicles, and the curved raceway segments include, parallel to and spaced from the inside guiding edge, an upright supporting wall which is lower than the inside guiding edge. The bridge of the toy vehicle includes a rod-shaped, downwardly directed support member which engages the groove-shaped space formed between the inside guiding edge and the supporting wall. A molded part is further provided, having a substantially L-shaped cross section, which mates with the curvature of the inside guiding edge and which is detachable from the curved raceway segment. A first leg of the molded part engages at a distance the groove-shaped space, thereby forming an aperture between the first leg and the upright supporting wall, and a second leg of the molded part is fixed in position on the raceway segment. The toy vehicle includes a front and a rear bridge which penetrate the aperture formed between the supporting wall and the first leg of the molded part and projects into the groove shaped space.

10 Claims, 2 Drawing Sheets

RACE TRACK HAVING LATERAL EDGES AND BRIDGES FOR RETAINING TOY VEHICLES

The invention relates to a race track system for toy vehicles with a raceway formed by straight and curved raceway segments with two driving lanes and current conductors embedded therein, in which system the segments of the raceway have lateral guiding edges on which the toy vehicles slide along with a bridge projecting beyond the lateral surfaces, and the curved segments of the raceway have on the inside an upright supporting wall with a height lower than the guiding edge, such supporting wall extending parallel with and spaced from the inside guiding edge, and in which system the bridge engages the groove-like space between the guiding edge and the supporting wall with a downwardly pointed, rod-like holding element, such bridge being placeable against the supporting wall by means of centrifugal force.

It is known to support high-speed toy vehicles on lateral guiding edges of the raceway with a bridge arranged on the front part of the vehicle by slight lateral tilting of the front wheels in the outward direction in order to avoid the use of track-holding pins. The toy vehicles so guided permit free lane changes. Furthermore, it is known to keep the toy vehicles within the curves on the inside driving lane by guiding a holding element, the latter being arranged on the bridge, on a supporting wall, the latter being associated on the inside with the inside guiding edge with a spacing from the latter. However, at high speeds, the toy vehicles tend to break out sideways by swinging around the holding element with their rearward ends, which adversely effects the operation of the game. Furthermore, toy vehicles driving at high speed and guided by a holding element perform tilting movements on the inside driving lane of curved track segments, causing the holding element to be lifted from the groove-like space between the guiding edge and the supporting wall and the vehicle to be freely thrown without guidance in the outward direction.

The objective of the invention is to safely guide toy vehicles moving at high speeds on the inside driving lane within the curved segments of raceways.

According to the invention, provision is made in a toy system of the type described above that a substantially L-shaped molded part matching in the longitudinal direction the curvature of the inside guiding edge of the raceway segment is detachably arranged on the curved segment of the raceway, such molded part, with one leg, gripping with a spacing across the groove-like space and being fixed on the raceway segment with the other leg; and that the toy vehicle has two bridges arranged with a spacing one after the other, which bridges extend through the gap between the supporting wall and the legs of the molded part and project into the groove-like space with holding elements formed on such legs. With their holding elements, the two bridges prevent the toy vehicle from being thrown off the raceway even when subjected to high centrifugal forces, whereas the toy vehicle is safely prevented from tilting off by the leg of the molded part acting as a cover for the groove-like space, with a clearance left for the passage of the bridges.

Another feature of the toy race track is that with its leg gripping across the groove-like space, the molded part rests on the guiding edge and, with clamping bodies arranged on the other leg, grips under the segment of the raceway, releasably supporting such segment by clamping. In this way, the molded parts can be selectively clipped to or removed from the curved segments of the raceway. Usefully, one curved segment of the raceway can form one quarter circle of the track and the inside guiding edge can receive two clipped-on molded parts. The molded parts, of course, may have any desired length, so that even more than one or two single molded parts may be applied to a curved raceway segment forming a quarter circle. Furthermore, suitably prepared molded parts can be arranged on raceway segments with a curved shape other than the circular form.

Preferably, the molded part is supported on the raceway segment by two clamping bodies fixed next to each other with a spacing therebetween on the molded part by plate elements and screws. Apart from the fact that such molded parts can be produced in uncomplicated injection molding dies, it is possible to form the clamping bodies from a particularly springy, elastic material different from the one of the molded part.

According to another feature of the toy racetrack, the front bridge is rigidly arranged on the toy vehicle and the rear bridge is detachably arranged on the vehicle. So that the toy vehicle may be operated even without support by the bridges, provision is made that the solidly fixed front bridge has coupling elements rigidly arranged on the bridge at the face ends of the latter, and that independent bridge segments can be slipped over such coupling elements with friction grip, such bridge segments having a holding member gripping or extending through the gap and projecting into the groove-like space. By slipping on the bridge segments and removing the rearward bridge, the toy vehicle is freely driveable on the raceway lanes. Finally, especially for compensating cross shocks, provision is made that the holding members can be bent down elastically crosswise relative to the lengthwise axis of the vehicle.

Preferably, the rearward bridge may be formed by an angulated flat strip, which is fixable on the toy vehicle and has strip-like holding members formed upright on the face ends of the flat strip, forming one piece with the latter. The rearward bridge may be secured by means of clamping means, for example screws. Cams extending on the outside of the free ends of the holding members across part of the height were found to be advantageous. Such cams permit a low-friction support of the toy vehicle on the guiding edges of the raceway segments, which keeps low wear on the bridges and guiding edges.

The invention is explained in greater detail with the help of an embodiment shown in the drawings, in which.

Figure 1:
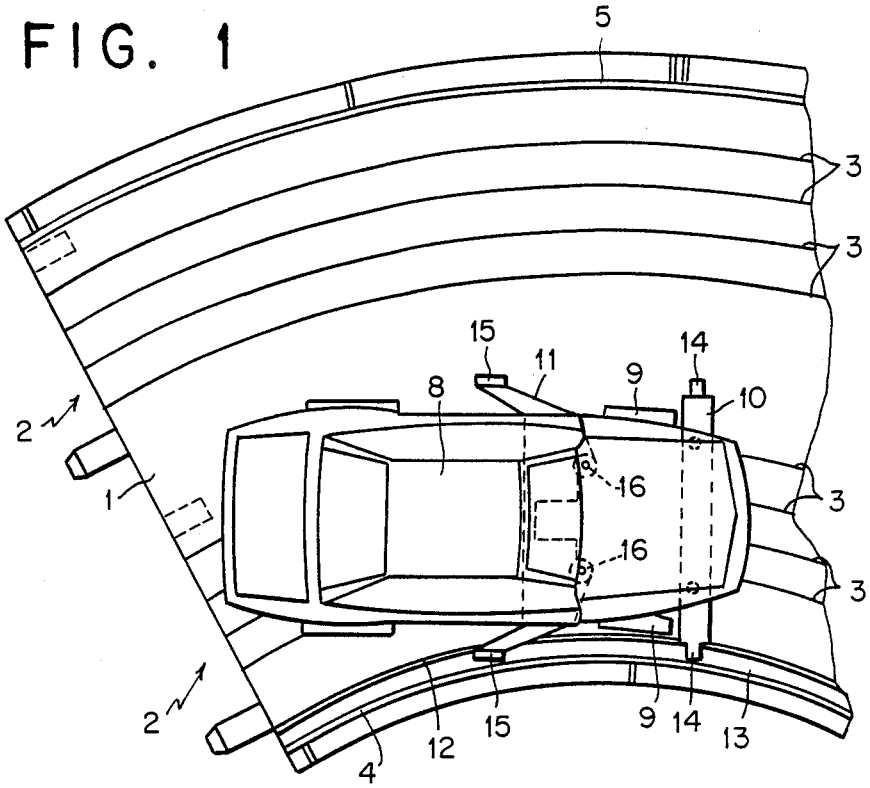
FIG. 1 is a top view of a part of a curved raceway segment with a toy vehicle on the segment.

Reference numeral 1 denotes a curved raceway segment having the two driving lanes 2 each having the four current rails 3. The raceway segment 1 is laterally bounded by an inside guiding edge 4 and an outside guiding edge 5. By means of the prongs 6 and the recesses 7, the raceway segment 1 can be plugged to additional raceway segments. Reference numeral 8 denotes a toy vehicle, which is freely driveable by motor power across the race track formed by the raceway segments 1. By slightly tilting the front wheels 9 outwardly, the vehicle 8 comes into contact with the guiding edges 4 and 5 with a front and a rear bridge 10 and 11, respectively, and slides along such edges. Along straight track sections, toy vehicle 8 can selectively drive along the inside or outside lane 2 by tilting the front wheels 9 accordingly.

Figure 2:
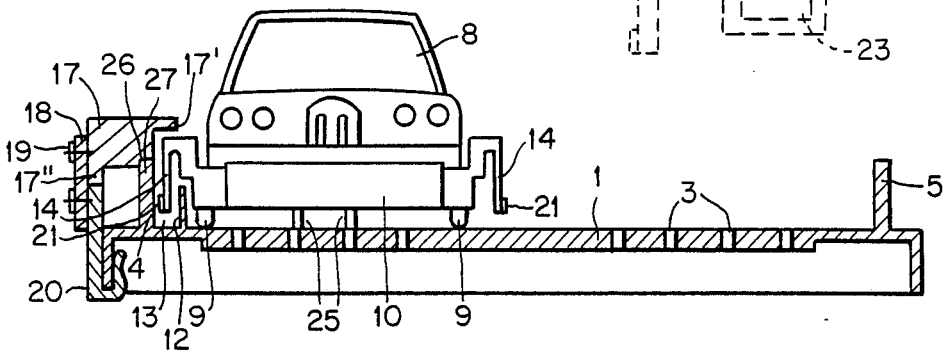
FIG. 2 shows a segment of the raceway with a sectional view of a molded part.
Figure 4:
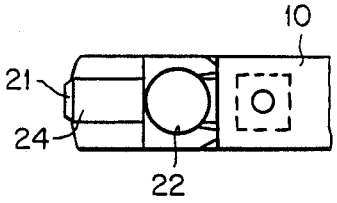
FIG. 4 is an enlarged top view of part of a bridge.
Figure 5:
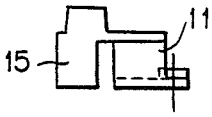
FIG. 5 is a side view of the rearward bridge.
Figure 6:
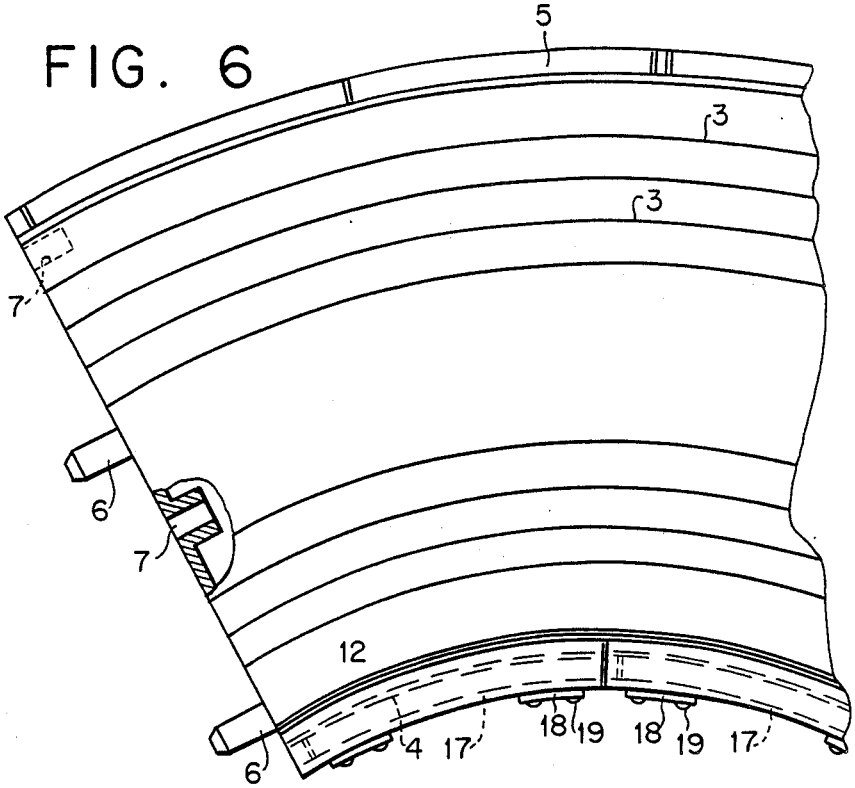
FIG. 6 shows part of a curved segment of the race track in a top view, with molded parts clipped to the segment.

Provision is made for an upright supporting wall 12 extending on the inside parallel with and spaced from the inside guiding edge 4, such supporting wall forming a groove-like space 13 jointly with the inside guiding wall 4 (FIG. 2). The front bridge 10 projects into such space 13 with a holding member 14, and the rear bridge 11 projects into such space with a holding member 15 as the vehicle travels through the curved raceway segment 1, causing the toy vehicle 8 to remain in the inside driving lane 2 against the centrifugal force even at higher speeds. The rearward bridge 11 may be formed by an angle flat strip, which is fixed on the toy vehicle 8 by means of the screws 16 and which has flat parts extending downwardly at its two ends and serving as the holding members 15.

So as to prevent the holding members 14, 15 from unintentionally slipping from the groove-like space 13, a molded part 17 is clipped to the raceway segment 1, such part 17 being detachably supported on the raceway segment 1 by means of the clamping elements 20, which are connected with the molded part 17 by means of the plate parts 18 and the screws 19. (FIG. 2). In such an arrangement, the molded part 17 supports itself on the face 27 of the inside guiding edge 4 with a bead 26.

Figure 7:
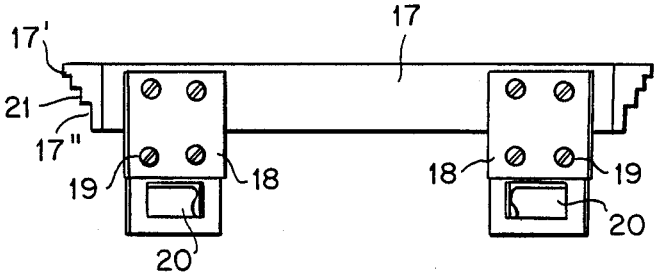
FIG. 7 is an enlarge side view of a molded part.

FIGS. 2 and 7 show that the molded part 17 has a substantially L-shaped design, projecting with a leg 17' with a spacing above the groove-like space 13, whereby the inside spacing is larger than the thickness of the bridges 11 or holding members. Reference numeral 17" denotes the other leg, which is engaged by the clamping elements 20. In this way, the toy vehicle 8 can freely move on the driving lane while being able of performing a slight tilting motion; however, the bridges 10, 11 with their holding members 14, 15 are prevented from completely lifting from the groove-like space 13. Usefully, each of the holding members 14 and/or 15 has a cam 21 located on the outside near the free end, for keeping low the friction and wear on the inner supporting edge 4.

Figure 3:
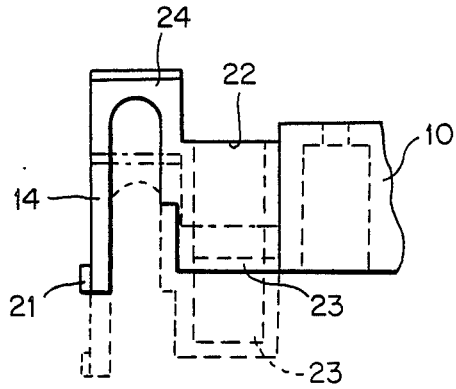
FIG. 3 shows an enlarged front view of part of a bridge.

So as to permit the toy vehicle 8 to drive across the segment of the raceway even without guidance, provision is made for the removal of the bridge 11 from the toy vehicle by removing the screws 16 and for detaching the free ends of the bridge 10. For this purpose, the bridge 10 has on its two ends the cylindrical parts 22 over which a pot-shaped connecting part 23 can be slipped with frictional grip, such part supporting a holding member 14 by way of a U-shaped extension 24. It is shown in FIG. 3 by the dash-dotted lines that for the removal of the holding member 14 from the bridge 10, the connecting part 23 can be pulled off downwardly. For maintaining the spacings between the toy vehicle 8 and the inside guiding edge 4, it is, of course, possible to place on the cylindrical part 22 a connecting part 23 with an extension 24 with a correspondingly selected length (not shown). Reference numeral 25 denotes current tappers, which contact the current rails 3.

What is claimed is:

1. An automobile race track toy set having a roadway formed by straight and curved raceway segments, with two lanes having embedded current conductors in which the raceway segments include inside and outside guiding edges, along which toy vehicles slide by means of a bridge, and the curved raceway segments include, parallel to and spaced from said inside guiding edge, an upright supporting wall lower in height than said inside guiding edge and in which said bridge, by means of a rod-shaped, downwardly directed supporting member engages a groove-shaped space formed between said inside guiding edge and said supporting wall and which can be placed on said supporting wall by means of centrifugal force, said race track toy set further comprising:

(a) a molded part which is substantially L-shaped in cross-section, and in its longitudinal direction it mates with the curvature of said inside guiding edge, arranged detachably fixed on said curved raceway segment by means of clamping elements;

(b) a first leg of said molded part spaced vertically from said upright supporting wall, so as to form an aperture into said groove-shaped space between said first leg and said upright supporting wall, and a second leg of said molded part being detachably fixed in position on said raceway segment by means of said clamping elements; and (c) said toy vehicle including a front and a rear bridge which penetrate said aperture formed by said supporting wall and said first leg of said molded part and project into the groove-shaped space.

2. Toy race track set according to claim 1, wherein said curved raceway segment forms a quarter circle of the raceway, and two molded parts extending across the inside guiding edge are arranged on the raceway segment.

3. Toy race track set according to claim 1, wherein a front bridge is rigidly arranged on said toy vehicle and the rear bridge is detachably fixed on said toy vehicle.

4. Toy race track set according to claim 1, wherein said supporting members is elastically bendable downwardly relative to the lengthwise axis of the vehicle.

5. Toy race track set according to claim 1, wherein said rear bridge is formed by an angled flat strip fixable on the toy vehicle and having strip-like supporting members formed upright on the face ends of said strip as one piece therewith.

6. Toy race set according to claim 1, wherein said second leg of said molded part is detachably fixed in position on said raceway segment by attachment to said inside guiding edge by said clamping elements which includes gripping means which grip beneath said raceway segment.

7. Toy race track set according to claim 1, wherein said clamping elements comprise a pair of spaced apart clamping elements each of which including a plate part attached to said second leg by screw means.

8. Toy race track set according to claim 1, wherein said front bridge has face ends to which are rigidly fixed coupling elements which releasably support an independent bridge segment having said supporting member which extends through the aperture between the first leg of said molded part and the upright supporting wall of the raceway segment to project into the groove-shaped space formed between the inside guiding edge and the supporting wall of the raceway segment.

9. Toy racetrack set according to claim 8, wherein said coupling elements comprise upright cylindrical elements connected to the face ends of said front bridge and each said independent bridge segment includes a connecting part which is complimentary shaped to a corresponding cylindrical element so as to engage therewith a friction grip and a U-shaped extension for supporting a corresponding supporting member.

10. Toy race track set according to claim 8, wherein on their free end, the supporting members have a cam extending from their outer periphery.

* * * * *